United States Patent [19]

Tamary

[11] Patent Number: 5,019,693

[45] Date of Patent: May 28, 1991

[54] TEMPERATURE CONTROL METHOD AND APPARATUS FOR FUSING ROLLER

[75] Inventor: Ernest J. Tamary, Rochester, N.Y.

[73] Assignee: Eastman Kodak Company, Rochester, N.Y.

[21] Appl. No.: 505,638

[22] Filed: Apr. 6, 1990

[51] Int. Cl.[5] ..... G03G 15/20; H05B 1/02

[52] U.S. Cl. ..... 219/471; 219/216; 355/290

[58] Field of Search ..... 219/216, 469, 470, 471, 219/494, 497; 355/290

[56] References Cited

U.S. PATENT DOCUMENTS

| | | | |
|---|---|---|---|
| 4,001,545 | 1/1977 | Wada | 219/216 |
| 4,035,612 | 7/1977 | Ishiguro | 219/469 |
| 4,144,835 | 3/1979 | Fukase | 219/216 |
| 4,512,649 | 4/1985 | Derimiggio | 219/216 |
| 4,672,177 | 6/1987 | Headrick | 219/216 |
| 4,920,250 | 4/1990 | Urban | 219/216 |

*Primary Examiner*—Teresa J. Walberg

*Attorney, Agent, or Firm*—Leonard W. Treash, Jr.

[57] ABSTRACT

The surface temperature of a fusing roller is controlled by sensing both the surface temperature and the temperature of a source of heat for said roller. Each temperature is compared to a nominal temperature for each to derive two error signals. The two error signals are combined to give a combined error signal, which is used to control the amount of energy applied to the source. The source can be an internally heated core or heated external roller riding on the fusing surface.

7 Claims, 1 Drawing Sheet

TEMPERATURE CONTROL METHOD AND APPARATUS FOR FUSING ROLLER

FIELD OF THE INVENTION

This invention relates to fusing systems, and more particularly to fusing systems which include a fusing roller the temperature of which requires accurate control.

BACKGROUND ART

Heated roller fusing systems for fixing toner images to a substrate generally heat at least one roller to an appropriate surface temperature to help fix a toner image to the substrate. Too low a temperature gives poor fusing quality and too high a temperature will distort the copy substrate and reduce the life of the fusing roller. Thus, substantial development has been devoted to control of the surface temperature of fusing rollers.

U.S. Pat. No. 4,046,990 shows a commercially used control system in which the temperature of the core is sensed and controlled according to the temperature projected to be on the surface of the roller. Since the surface temperature varies according to whether the fuser is in an "idle" condition or a "run" condition the set point for the core is varied according to whichever condition it is in.

More common modern control devices involve sensing the surface temperature itself. For example, the amount of energy applied to the core is controlled according to the difference between the temperature sensed on the surface and an appropriate set point. After an elongated period of idle, a relatively cool core is difficult to bring immediately up to a high enough temperature to raise the surface temperature to compensate for losses to substrates carrying images being fused. This phenomena is commonly called temperature "droop".

A more sophisticated algorithm raises the surface temperature set point when the start copy button is pressed, thereby immediately creating an error signal and increasing the power to the source. This approach reduces droop, but if a core is still warm from a previous long run there will be a substantial temperature "overshoot", characterized by a period in which the fuser temperature is hotter than desirable.

STATEMENT OF THE INVENTION

It is an object of the invention to provide a method and apparatus for controlling the surface temperature of a fusing roller of a roller fusing system of the type having a fusing roller and a source of heat for said fusing roller, which method reduces both droop and overshoot.

This and other objects are accomplished by sensing the temperature of the surface and comparing it to a nominal temperature to obtain a first error signal and sensing the temperature of the source, for example the core, and comparing it to a nominal temperature to obtain a second error signal and combining these error signals and increasing the heat added to the source as a function of the combined error signals.

According to a preferred embodiment, since this approach is primarily useful when the apparatus is in a "run" mode, it is not applied during an "idle" mode.

With this approach to controlling the temperature, more heat will be added to the system at the beginning of a run when the core is cool than when it is warm, but the system will still be responsive to the surface temperature for actual control. This system thus greatly reduces droop and overshoot while maintaining accurate control during a run.

According to preferred embodiments, the invention can be applied to both internally and externally heated rollers.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
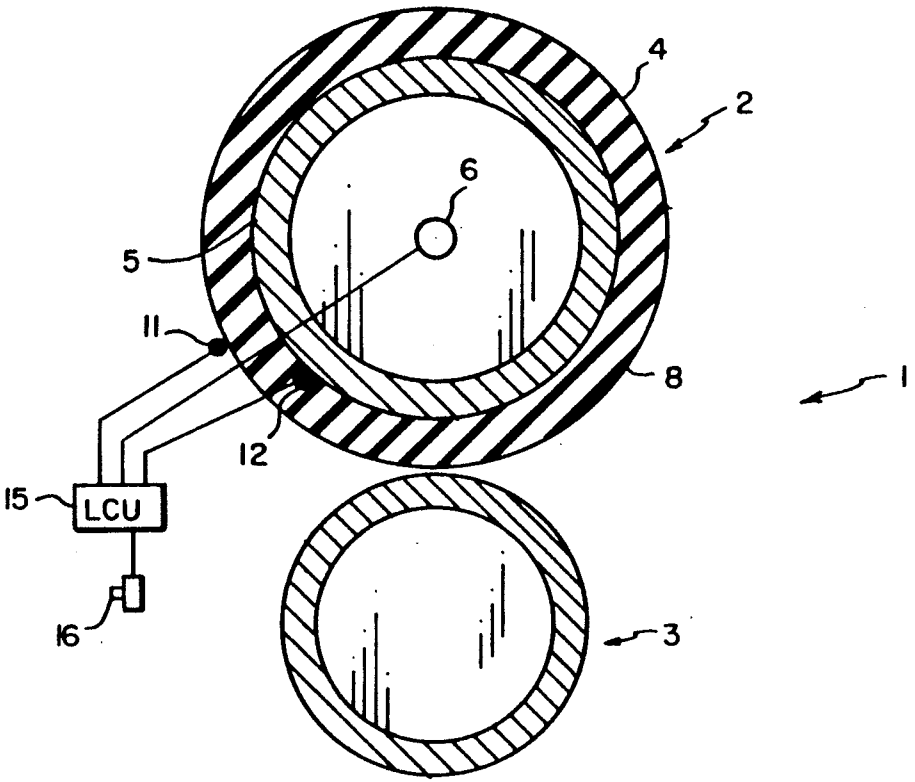
FIG. 1 is a schematic cross-section of an internally heated fusing roller and pressure roller combination.

According to FIG. 1, a roller fuser 1 includes a fusing roller 2 and a pressure roller 3. Conventionally, the pressure roller is relatively hard and the fusing roller has a soft elastomeric outer layer or set of layers 4 which, when under pressure from the pressure roller, creates a nip in which a substrate carrying a toner image is passed. The elastomeric outer layers 4 are coated or otherwise affixed to a metallic core 5 which is heated by an internal heat element 6, for example, a lamp.

The outer surface 8 of the elastomeric layers must be controlled within fairly tight tolerances to assure adequate temperature for fusing without damaging the fusing roller or the substrate. According to the invention, this is accomplished by means for sensing the temperature TR of the surface 8, for example, a surface temperature sensor 11 and means for sensing the temperature TC of the core 5, for example, core temperature sensor 12. The temperatures sensed by the sensors 11 and 12 are fed into a logic and control unit 15 which also receives inputs from other portions of the apparatus, for example, signals from start button 16.

Figure 2:
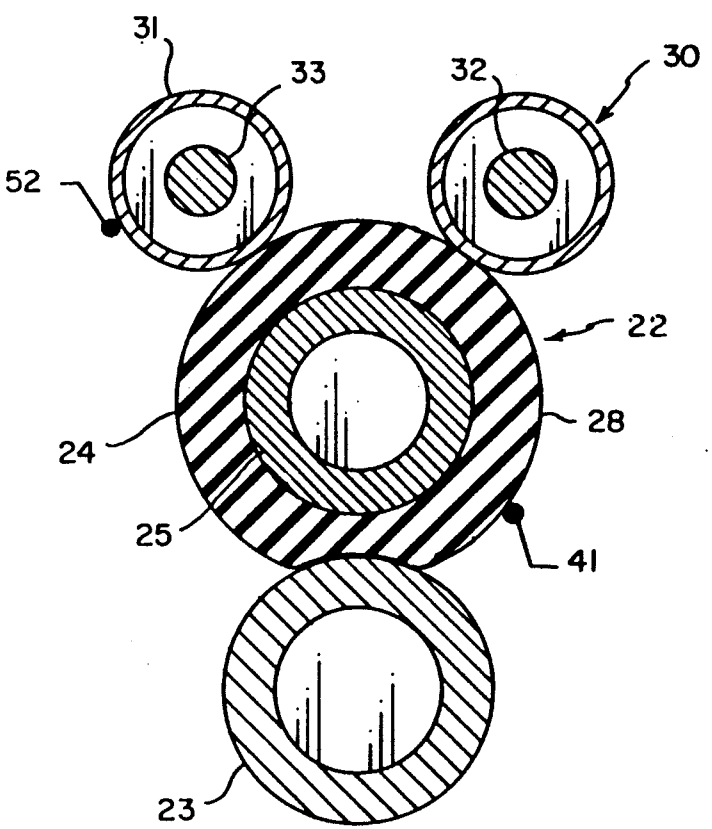
FIG. 2 is a schematic cross-section of an externally heated fusing roller and pressure roller combination.

Roller fusers are also known in which the fuser roller is heated externally. According to FIG. 2, a fusing roller 22 has a thick elastomeric outer layer or layers 24 on an inner core 25 which can be insulating or have an insulating surface to prevent the dissipation of heat. Such fusing rollers also cooperate with a pressure roller 23 to form a nip as in FIG. 1.

Fusing roller 22 is heated externally by one or more heating rollers 30 and 31 which are heated by internal heating devices 32 and 33. As in FIG. 1 the surface 28 of the fusing roller 22 is sensed by a surface temperature sensor 41 and the temperature of the heat source is sensed by a source temperature sensor 52 positioned on the surface of one of the heating rollers 31.

In both embodiments the core 5 and the heating rollers 30 and 31 are constructed of metal whose temperature directly affects, but can be substantially different from, the elastomeric layers 4 and 24 of the fusing rollers. When the start button is pressed the temperature sensed by the surface temperature sensors 11 and 41 does not represent a full indication of how much heat must be added to bring that surface up to its appropriate temperature. That required heat is also a function of the temperatures of the sources 5, 30 and 31. According to the invention, the temperature of both the surface of the fusing roller and the temperature of the source is sensed.

Each of those temperatures is compared to a nominal temperature for that sensor providing error signals indicative of the difference between the temperature of the surface and its nominal temperature and the temperature of the source and its nominal temperature. These two signals are combined according to an appropriate weighting that must be determined according to the parameters of each system. The combination provides a combined error signal which is then used to determine the amount of heat to be added to the source.

Expressed mathematically, the combined error signal E is determined by the following formula:

$$E=a(TR_1-TR)+b(TC_1-TC)$$

where E is the combined error signal, TR is the sensed temperature of the surface, TC is the sensed temperature of the source, $TR_1$ is the nominal temperature of the surface and $TC_1$ is the nominal temperature of the source and a and b are constants chosen for the system.

Utilizing this system a might be three times as large as b to give appropriate weighting to the sensed surface temperature. If the set point or nominal temperature of the surface is 360 degrees and the actual temperature is sensed at 350 degrees, $TR_1-TR$ is equal to 10. If $TC_1$ is 400 degrees and TC is sensed at 300 degrees $TC_1-TC$ would be equal to 100 degrees. In this example if a is equal to 3 and b is equal to 1 then $E=30+100$ or 130 which number is used to determine how much wattage should be applied to the lamps inside the core or heated rollers. This high an error signal would represent a cool core. The fusing roller is in risk of having substantial droop when the start button is pressed and substrates begin to be fed into contact with surfaces 8 or 28. Thus, substantial heat is added to warm the core before substrates even touch the fusing roller. If the core is already quite warm, for example, it is 395 degrees because it has just finished a long run, then E is equal to 35 and a greatly reduced amount of heat is added by the lamps thereby preventing a condition of overshoot.

Although this system can be used while the apparatus is in idle, it really serves no useful purpose in that mode, since it is generally desirable to have the core gradually cool down while the temperature at the surface is maintained at an appropriate idle temperature. Therefore, according to a preferred embodiment, appropriate programming is applied to the logic and control unit 15 to determine when the apparatus is in a run or in an idle mode and to apply the combined error signal E only after the start button 16 has been pressed, i.e., when it is in a run mode. Mathematically speaking, constant b can be treated as 0 when the apparatus is in an idle mode. Constant b is greater than 0, as picked according to the parameters of the system, when the apparatus is in a run mode.

Although simple circuits could be used to do the comparisons and additions, in modern equipment such circuits are not used. The calculations are done in appropriate programming in the LCU which calculations are well within the skill of the art.

The invention has been described in detail with particular reference to a preferred embodiment thereof, but it will be understood that variations and modifications can be effected within the spirit and scope of the invention as described hereinabove and as defined in the appended claims.

I claim:

1. A method of controlling the surface temperature of a fusing roller of a roller fusing system of the type having a fusing roller and a source of heat for said fusing roller, said method comprising:

sensing the temperature TR of said surface, and comparing it to a nominal temperature $TR_1$ to obtain an error signal, sensing the temperature of said source TC and comprising it to a nominal temperature $TC_1$ to derive an error signal, combining said error signals using a predetermined weighting to derive a combined error signal E, and increasing the heat added to said source as a function of said combined error signal E.

2. The method according to claim 1 wherein said method further includes determining whether said fuser is in an idle mode of operation or a run mode of operation and when in said idle mode using only the error signal derived from sensing the temperature of the surface.

3. A fusing apparatus comprising:

a fusing roller having an outer fusing surface, a source of heat for said fusing roller, means for sensing the temperature of said fusing surface, means for sensing the temperature of said source, means for comparing the temperature TR of said surface with a nominal temperature $TR_1$ and the temperature TC of the source with a nominal temperature $TC_1$ to obtain error signals, and for combining said error signals according to the formula $$E=a(TR_1-TR)+b(TC_1-TC)$$

wherein a and b are constants chosen for the system, and means for increasing the heat added to said source according to the size of the combined error signal E.

4. The apparatus according to claim 3 wherein said source is a core for said fusing roller which core is heated by a heating element located inside the core.

5. The apparatus according to claim 3 wherein said source is external to said fusing roller and contacts said fusing surface to directly heat it.

6. The apparatus according to claim 5 wherein said source is a heated roller which rolls on said outer surface.

7. The apparatus according to claim 3 wherein a is greater than b.

* * * * *